US006579036B2

(12) United States Patent
Attar

(10) Patent No.: US 6,579,036 B2
(45) Date of Patent: Jun. 17, 2003

(54) REFLECTIVE PAVEMENT MARKER AND METHOD OF MAKING

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 09/887,856

(22) Filed: Jun. 22, 2001

(65) Prior Publication Data

US 2002/0197108 A1 Dec. 26, 2002

(51) Int. Cl.[7] ..... E01F 11/00; G02B 5/122

(52) U.S. Cl. ..... 404/16; 404/14; 359/536; 428/145

(58) Field of Search ..... 404/14, 15, 16; 428/145, 162; 359/536, 531; 116/63 R, 63 P

(56) References Cited

U.S. PATENT DOCUMENTS 3,954,324 A * 5/1976 Arnott et al. ..... 359/531
4,726,706 A * 2/1988 Attar ..... 116/63 R
5,425,596 A * 6/1995 Steere et al. ..... 404/14
5,927,897 A * 7/1999 Attar ..... 404/12
D422,932 S * 4/2000 Khieu et al. ..... D10/113
6,365,262 B1 * 4/2002 Hedblom et al. ..... 359/536
6,376,576 B2 * 4/2002 Kang et al. ..... 523/202

* cited by examiner

*Primary Examiner*—Robert E. Pezzuto
*Assistant Examiner*—Raymond W Addie

(57) ABSTRACT

A reflective pavement marker comprises an integrally molded one-piece structural body and at least one reflective plate attachment, said structural body having two opposing planar inclined reflective faces, multiple hollow cavities which are defined by partitioning and load carrying walls with wedge shaped top surfaces, said hollow cavities open within a recessed portion of said reflective faces, two arcuate sides and integrally sealed planar base surface with textures and recessed grooves. The reflective plates are welded within the periphery of said recessed portion that includes wedge shaped top surfaces of the hollow cavity walls. This marker provides to enhance the reflective cell sizes, improved impact resistance and improve resistance to flexural stresses due to automobiles impact forces; this is accomplished by maximizing the base surface area for adhesive wetting parameter. The body can be made of various recycled or virgin structural plastics with high impact resistance and UV stability.

1 Claim, 8 Drawing Sheets

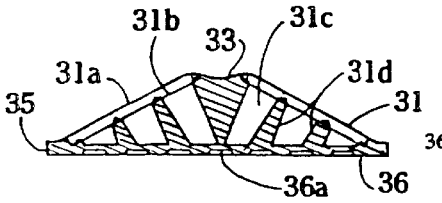
FIG. 4
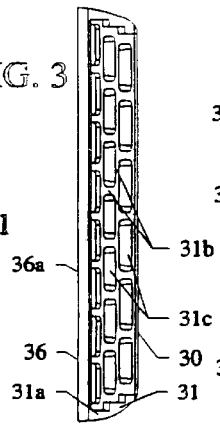
FIG. 3
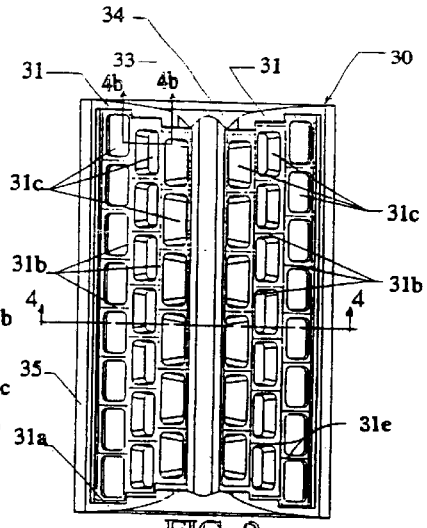
FIG. 2
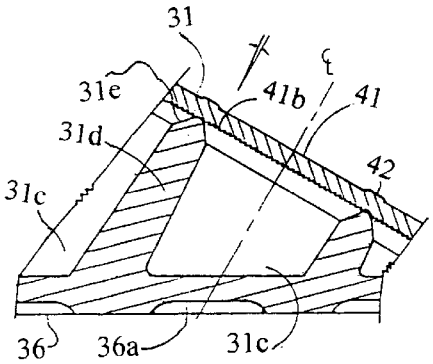
FIG. 4b
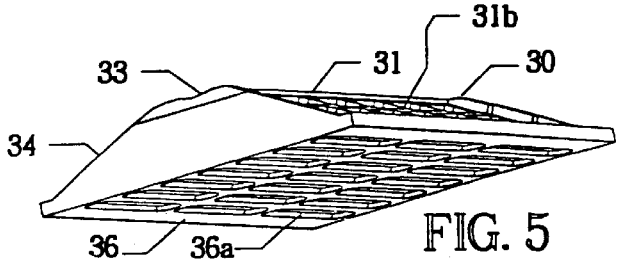
FIG. 5
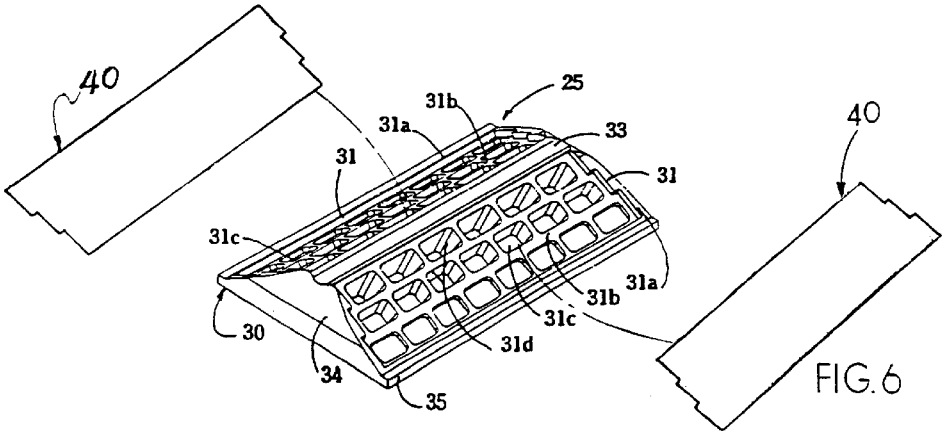
FIG.6
FIG.1

FIG.12A
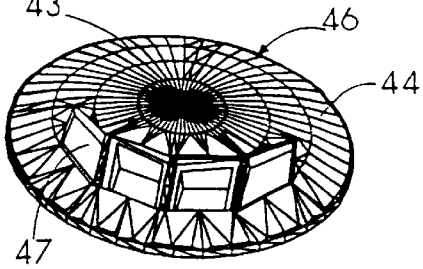
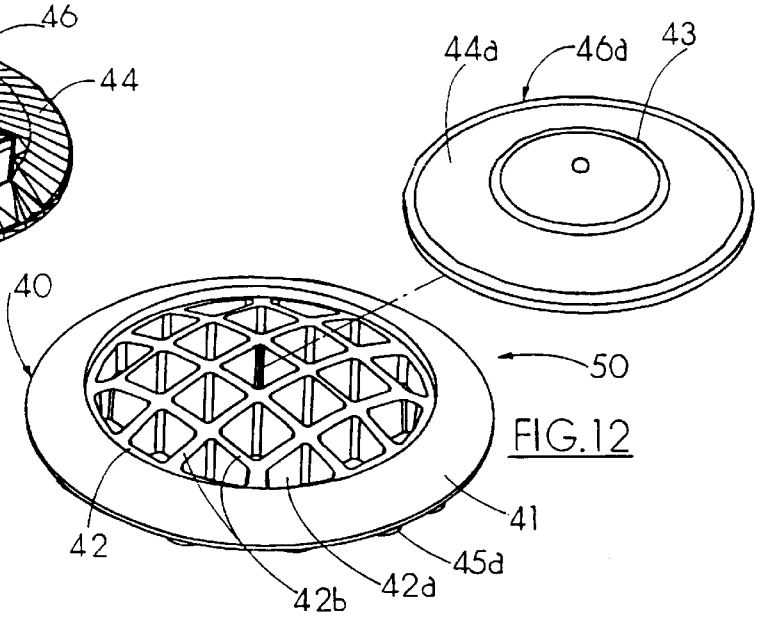
FIG.12
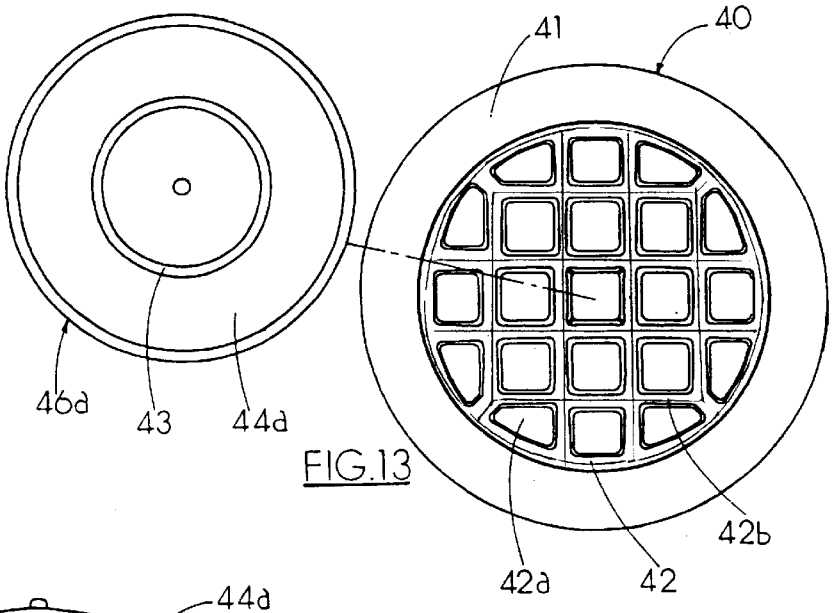
FIG.13
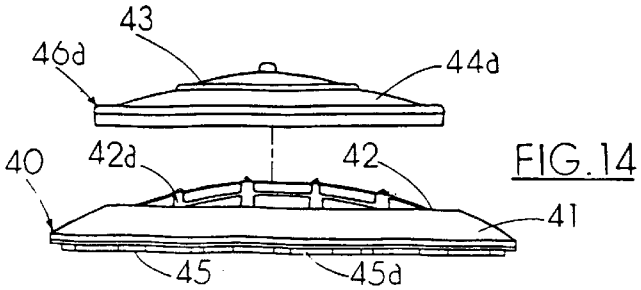
FIG.14

REFLECTIVE PAVEMENT MARKER AND METHOD OF MAKING

BACKGROUND OF THE INVENTION

1. Field of the Invention

This invention relates to reflective roadway markers that are used for traffic lane delineation, in particular, to markers with enhanced reflectivity, impact resistant, sealed base surface and low cost.

2. Related Art

Roadway markers are adhered to pavements along centerlines, edge lines, lane dividers or guardrail delineators. Other roadway markers are used as temporary lane dividers in temporary constructions, detours or prior to permanent marking of newly paved roadways. Since 1965, the most commonly used reflective roadway markers are based on Heenan U.S. Pat. No. 3,332,327 or Balint U.S. Pat. No. 3,409,344. Typically, this type of markers is produced in a process consisting of four to five steps, First, injection molding of a thermoplastic shell, either integrally molded with the reflective face, or the reflective faces welded on a corresponding open recesses within the shell. The reflective face, having 350 or more cube corner reflective elements on each reflective face of the shell. Secondly, either the cube corner reflective elements within a shell or the entire inside surface of the shell coated with a reflective sealer by a process known as vacuum metalizing. This metallic sealer needed to seal the cube corner reflective elements so they retain part of their reflectivity prior to the next step, of filling the shell with a thermosetting resinous material, such as epoxy or polyurethanie.

This resinous filler material encapsulate the metalized cube corner reflective elements and give the marker the structural body. Finally, a layer of relatively course sand or glass beads dispersed over the top surface of the filler material prior to solidification of the filler material.

Part of the sand particles will remain partially protruding above this planar surface of the marker base, thereby increase the adhesive wetting parameter of the base surface. This will improve adhesion to substrate, regardless of the type of adhesive used. This type of markers worked well for six or seven months, however, due to poor abrasion and impact resistant of the thermoplastic shell, nearly 60% of the reflectivity is lost thereafter. Also, since the coefficient of thermal expansion of the shell material and the resinous filler material vary, this causes pealing of the reflective face or the shell from the resinous body, thereby losing reflectivity. Several attempt were made to improve abrasion resistant of the reflective face. One was the use of thin layer of glass, in U.S. Pat. No. 4,340,319, Another attempt was the use of polymeric coating of the reflective face, as disclosed in U.S. Pat. No. 4,753,548 to Forrer. These abrasion resistant coating proving to be expensive and tend to reduce reflectivity. Other major development in the pavement marker art has been made in the attempt to eliminate the use of the metalized sealer for the cube corner reflective elements. This has been achieved by dividing the inside surface of the reflective face into reflective cells, each cell will have several cube corner reflective elements, the cells isolated from each other by partition and load carrying walls. The entire reflective face welded to corresponding recesses within a hollowed or solid body. This method is disclosed in U.S. Pat. No. 4,227,772 (Heenan); U.S. Pat. Nos. 4,232,979; and 4,340,319 (Johnson et al); U.S. Pat. No. 4,498,733 to (Flanagan). These markers proved to be superior in reflectivity, however, lack of enough adhesive wetting parameter lead to poor adhesion to roadways, hence caused short life cycle for this type of markers. This applicant successfully developed two markers with non-metalized multi-cell reflective roadway. One roadway marker utilizes raised rhombic shaped abrasion reducing and load transferring raised ridges, which act to intercede abrasion elements and impact load, the shell filled with impact resistant epoxy.

The marker body is having a base with large wetting parameter for shear and flexural strength, as disclosed in U.S. Pat. No 4,726,706 to Attar.

The second roadway marker of this applicant, U.S. Pat. No. 5,927,897 developed a mean to increase the abrasion resistant of the reflective face by coating the reflective face with diamond-like film and by having holding pins extended beyond the partition walls into the body, the holding pins sealed by the filler material; this works very effectively, providing structural strength and maximum adhesive wetting parameter. The entire above reflective pavement markers are incorporated herein by reference in their entireties. Applicant present goal to have a roadway marker having: high reflectivity, enhance structural body, abrasion resistant, low cost, marker base area with maximum wetting parameter and very simple yet consistent process to manufacture.

SUMMARY OF THE INVENTION

This invention provides a novel raised pavement marker that comprises means to formed the body with hollow cavities, said hollow cavities having wedge shaped top surfaces at the open ends within a recessed portion of the reflective faces. At least one reflective face having multiple of cube corner reflective elements sonically welded on said wedge shaped top surfaces, thereby forming air gaps beneath the reflective elements, said body is formed with sealed base and large adhesive wetting parameter for better adhesion to the pavement and higher resistance to flexural stresses.

The primary object of this invention is to eliminate the multi steps process in prior arts for making reflective and non-reflective pavement markers while retaining maximum base surface area, maximum reflective faces and minimum partition and load carrying spacing.

Another objective of this invention is to provide a raised roadway marker made of high impact, abrasion resistant material, and low cost. The present invention further provides a method of making one piece body for raised roadway markers of any desirable shape and configuration. In accordance with still further aspect of this invention, the marker can be made with one or two reflective faces, this will cost considerably less to install to the roadway, or two multi colored parts can be welded together, each with one reflective face opposite the other.

BRIEF DESCRIPTION OF THE DRAWINGS

FIG. 1 is an isometric view of a preferred one-piece marker body and reflective plates;

FIG. 2 is a plan view of the pavement marker body, as illustrated in FIG. 1;

FIG. 3 is an elevation view of the pavement marker body, as in FIG. 1;

FIG. 4 is a cross section view taken along the line 4—4 of marker body, as in FIG. 2;

FIG. 4*b* is a sectional view taken along line 4*b*—4*b* of FIG. 2;

FIG. 5 is isometric view of marker in FIG. 1 showing planar base surface with discontinuous grooves;

FIG. 6 is a view of a reflective plate for attachment in the one-piece body of marker in FIG. 1;

FIG. 12 is an isometric view of a spherical embodiment of marker with hollow body of the invention;

FIG. 12*a* is a spherical cap with built in reflective cells for the marker body as in FIG. 12;

FIG. 13 is a plan view of the cap portion and the marker body, as in FIG. 12;

FIG. 14 is an elevation view of the cap portion and the marker body in FIG. 12;

DETAIL DESCRIPTION OF PREFERRED EMBODIMENTS

Figure 7:
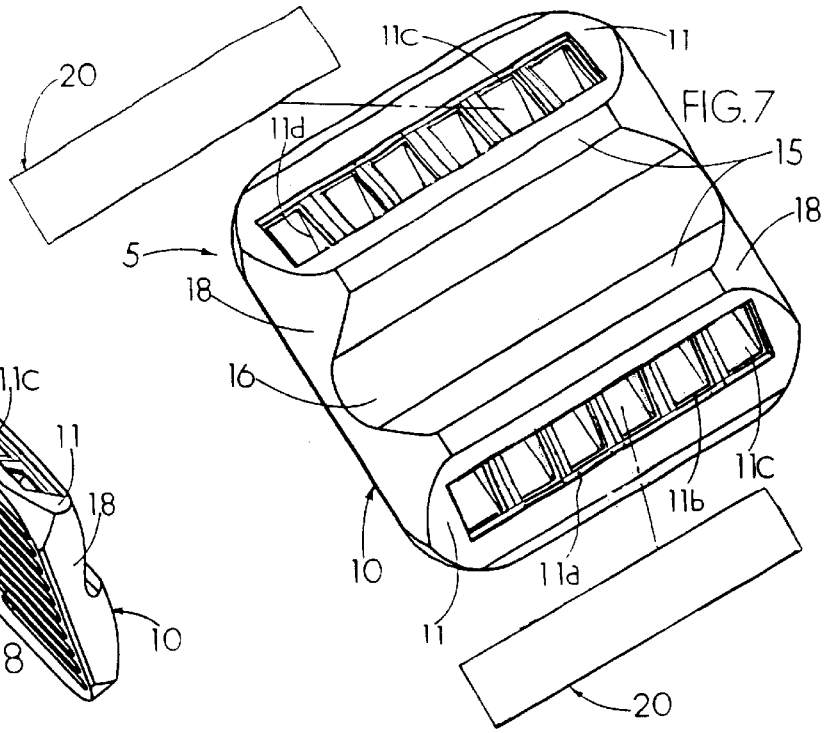
FIG. 7 is isometric view of another embodiment of marker with one-piece body of the invention.
Figure 8:
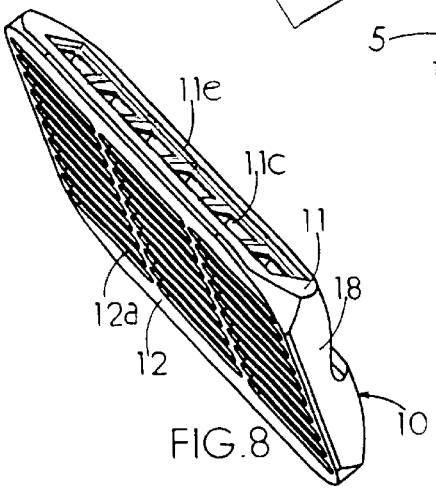
FIG. 8 is isometric view of marker body, as in FIG. 7 showing a sealed and grooved planar base surface.
Figure 10:
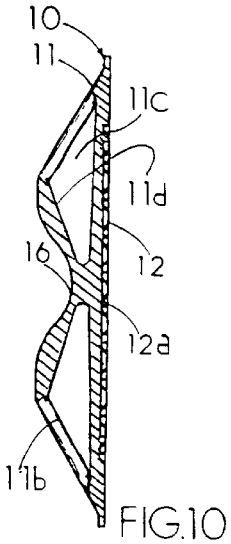
FIG. 10 is a cross section view taken along the line 10—10 of marker body, as in FIG. 9.
Figure 9:
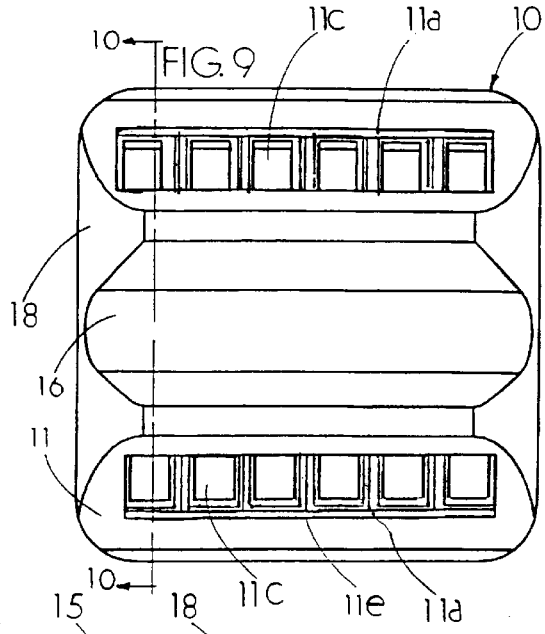
FIG. 9 is a plan view of the marker body, as in FIG. 7 showing the curved sides and reflective face.
Figure 11:
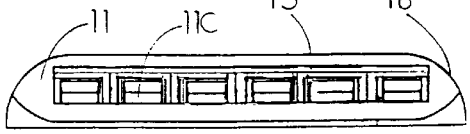
FIG. 11 is an elevation view of the marker body as in FIG. 7.
Figure 16:
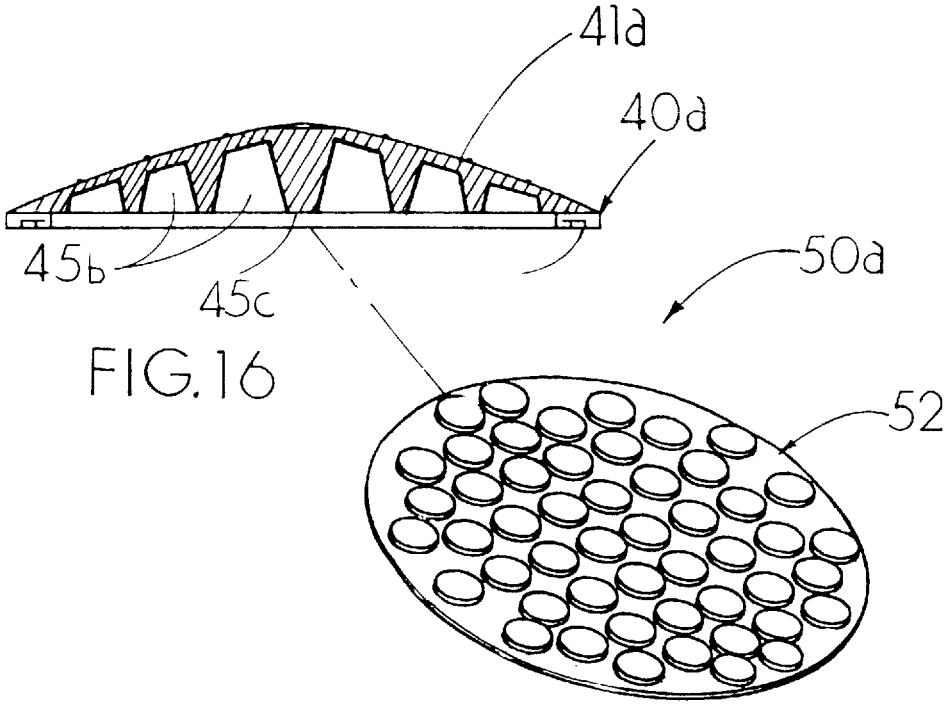
FIG. 16 is a section view along line 16—16 of marker body, as in FIG. 15.
Figure 15:
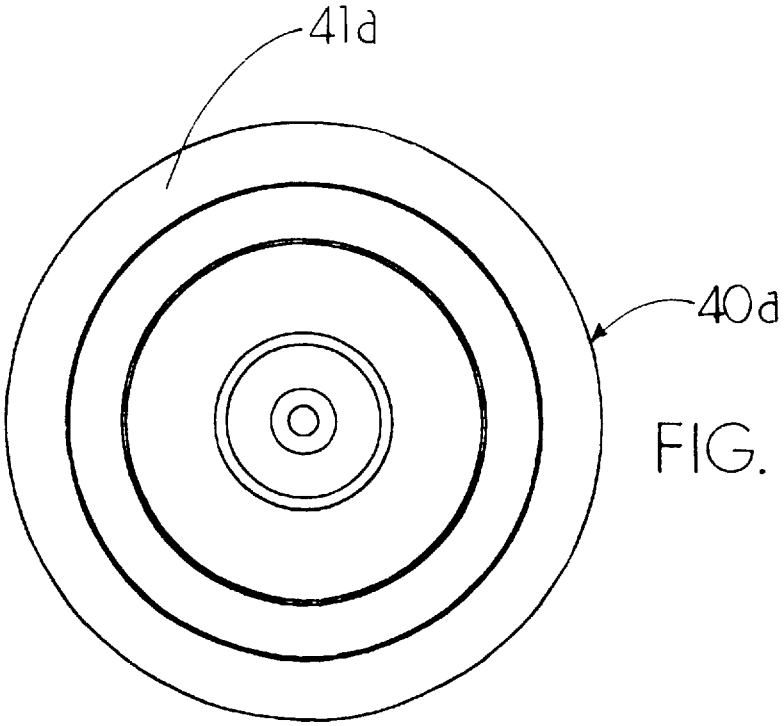
FIG. 15 is a plan view of a non-reflective marker with spherical body and raised ridges.
Figure 17:
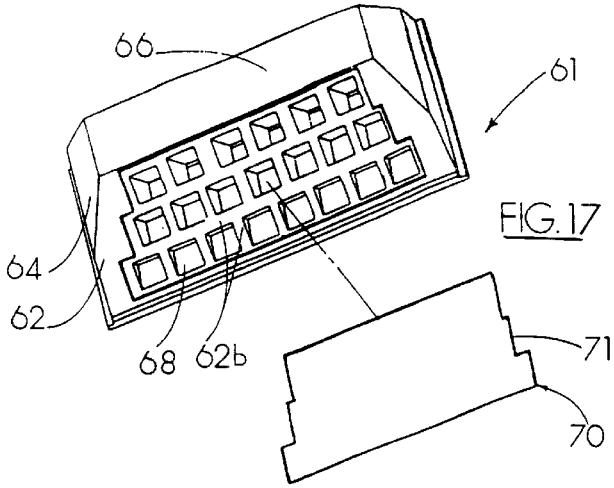
FIG. 17 is an isometric view showing part of another preferred embodiment of the invention.
Figure 18:
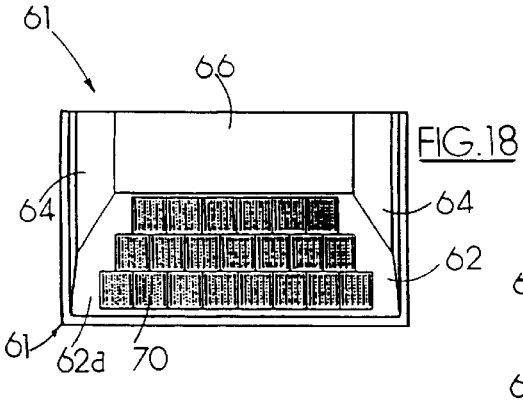
FIG. 18 is a plan view of the reflective marker part in FIG. 17 with attached reflective plate.
Figure 19:
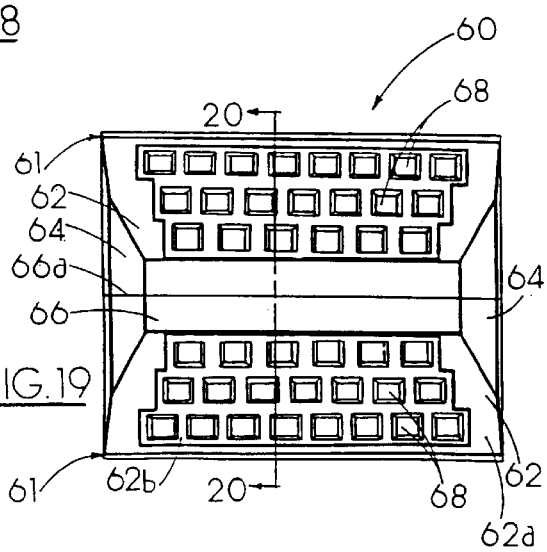
FIG. 19 is a plan view of welded two parts forming two ways marker based on FIG. 17 part.
Figure 20:
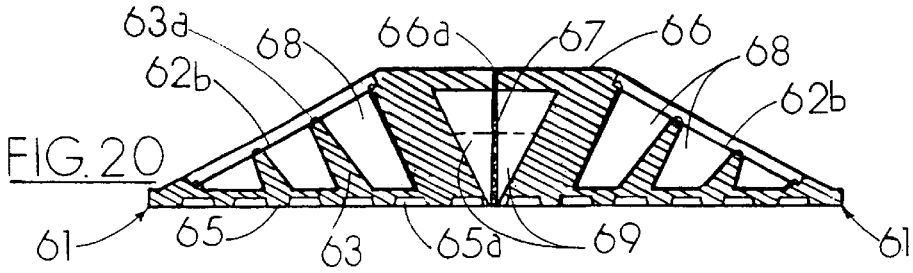
FIG. 20 is a cross sectional view taking along line 20—20 in FIG. 19.
Figure 21:
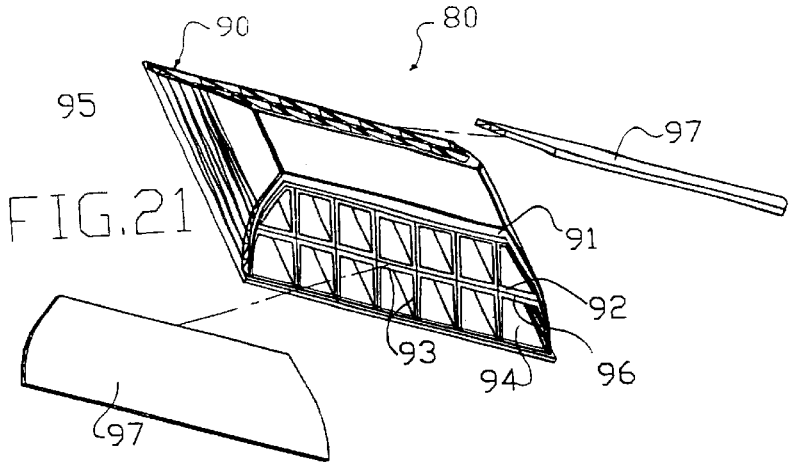
FIG. 21 is an isometric view of another preferred reflective marker embodiment of the invention.

A durable, cost effective and simplified production method for reflective and non-reflective roadway markers with maximum resistant to flexural stresses can be achieved by integrally forming a lightweight marker body in one step from one of various available structural polymers, said marker body can be integrally formed in such a way reducing excessive material while retaining structural strength and optimum adhesive wetting area for the base surface.

This invention satisfies the above conditions.

Referring to FIGS. 1 to 6 represent one of the preferred embodiments of a reflective pavement marker designated by the number 25, comprises of a one piece structural body 30 integrally includes multiple hollow cavities 31*c* and at least one reflective plate 40 attachment. Structural body 30 integrally having two inclined planar faces 31 for reflective plate 40 attachment, two arcuate sides 34, a top portion 33 and sealed planar base surface 36 that includes multiple textured arcuate grooves 36*a*. The inclined faces 31, each having a planar surface 31*a* and a recessed portion 31*b* where a reflective plate 40 can be welded or agglutinated. Recessed portion 31*b* is where the top wedge shaped surfaces 31*e* of the hollow cavities walls 31*d* are located. Hollow cavities 31*c*, each having centerline near perpendicular to the inclined planar faces 31. FIG. 4*b* shows a section view of a hollow cavity 31*c* showing the cavity walls 31*d* having wedge shaped top portion 31*e*. Each wall 31*d* form an angle, preferably about 2 to 5 degrees with respect to the centerline of said hollow cavities. The depth of hollow cavities 31*c* can be terminated about 0.05 to 0.15 inch above the sealed outside planar base surface 36 with extended lips 35. This depth for hollow cavities 31*c* allows body 30 to retain a sealed base surface.

The thickness of hollow cavity walls 31*d* at the lower end of wedge shaped top surface 31*e* is about 0.07 to 0.20 inch at the planar recess portion 31*b* of the inclined planar face 31.

The inclined planar faces 31 form an acute angle with respect to the planar base surface 36, said acute angle, preferably having a value of about 28 to 30 degrees. The reflective plate 40 is welded to the round top surfaces of wedge shape 31*e* of the hollow cavity walls 31*d* and to the periphery of the recessed portion 31*b*, fusing a thin portion of the inside of reflective plate 40 to said surfaces, thereby forming a cell like reflective segments within the inside surface of plate 40. Each of said cells having plurality of cube-corner reflective elements 41*b* freely open within each corresponding hollow cavity 31*c*. The relatively thick walls 31*d*, with wedge shaped top surface 31*e* will significantly improve the impact resistance of body 30 as well as maximizing the cells inside surface areas after welding the reflective plate 40 to body 30.

The air gap formed beneath the cube corner reflective elements within each hollow cavity 31*c*, allows maximum reflectivity without the need for metalizing the reflective elements. The outside surface of the reflective plate 40 will have corresponding cell like planar reflective areas 41, having similar shapes as the open ends of cavities 31*c*. Preferably, the outside cell like planar areas 41 can be recessed about 0.01 to 0.010 inch bellow said outside planar surface of the reflective plate 40, thereby defining ridge like walls 42. Several shapes or sizes of hollow cavity 31*c* can be selected for marker body 30, hence forming a corresponding cell like planar reflective areas 41 for the reflective plate 40.

The following U.S. Patents provide suitable reflective plate or cube corner reflective element design, U.S. Pat. No. 3,712,706 to Stamm, U.S. Pat. No. 4,208,090 to Heenan, U.S. Pat. No. 4,232,979 to Johnson, U.S. Pat. No. 4,498,733 to Flanagan and U.S. Pat. No. 4,726,706 to Attar, all of which are incorporated herein as reference in their entireties.

Reflective plate 40 can be coated with an abrasion resistant layer of either diamond-like carbon or silicon dioxide film, using suitable plasma enhanced chemical vapor deposition method.

A preferred method for carbon coating is using radio frequency plasma decomposition from an alkane, such as n-butane or propane; other alkanes also can be used, with a pair of ultra pure carbon electrodes horizontally positioned and at a vertical spacing from each other. The reflective plate 40 is positioned on the lower electrode. Pavement marker body 30 can have any commonly used size or shape. Preferably, the base area 36 will have about 4.0 to 5.0 inches in width, and the depth to be about 2.0 to 4.0 inches and the marker height can be about 0.50 to 0.70 inch. Several recycled or virgin polymeric materials available that is compatible to the reflective plate 40 material and suitable for the production of marker body 30. Typically, the polymer material used to make the reflective plates 40 is transparent acrylic or polycarbonate thermoplastic.

Referring to FIGS. 7 through 11, there is shown an alternative embodiment of a roadway marker 5 having a one-piece body 10 integrally formed from any desired structural polymer, said marker body 10 having two hump portions 15, each hump portion integrally having concave curve shaped reflective face 11 which includes a planar recessed surface 11*a*, said recessed surface 11*a,* including open ends of hollow cavities 11*c* and the wedge shaped top surfaces 11*b* of load carrying walls 11*d* defining said hollow cavities. The two hump portions 15 are integrally connected by a scalloped recess portion 16. The marker body also having two arcuate sides 18 and sealed planar base surface 12 with textured and grooved surface 12*a*. Load carrying walls 11*d* each having a wedge shaped top surface 11*b* slightly recessed bellow the curved surface 11.

The centerline of each hollow cavity 11*c* is parallel with respect to the planar base surface 12. Reflective plate 20 is having multiple of cube corner reflective elements on the inside surface, and planar outside surface. Plate 20 can be welded or agglutinated to the wedge shaped top surfaces 11*b* within the recessed area 11*a*.

Each of reflective plates 20 having an outside planar surface that will be positioned slightly bellow the curved surface 11 and having an inside surface with cube corner reflective elements sealed freely within an air gap inside of each corresponding hollow cavities 11*c*. Reflective plate 20 can be coated with abrasion resistant diamond-like carbon film, or silicon dioxide film, to enhance durability. FIGS. 12 through 16 illustrate yet another embodiment of reflective or non-reflective roadway markers, in accordance to the present invention. Marker 50 has an integrally made body 40 having a rounded spherical shaped top surface 41 with a slightly recessed center portion 42, said center portion 42 divided into multiple hollow cavities 42*a* by partition and load carrying walls 42*b*. Walls 42*b* are tapered inward, forming 3 to 5 degrees angle with respect to the centerline of each hollow cavity 42*a*. Hollow cavities 42*a* terminate about 0.10 inch above the sealed outside planar base surface 45 with raised pens 45*a*, said raised pens 45*a* protrude less than 0.06 inch beyond the sealed planar base surface 45. Cap portion 46 is attached to body 40. Cap portion 46 has thickness and contour correspond to the recessed center portion 42 of body 40. Cap portion 46 having an outside surface with raised ridges 43. Cap portion 46 having an inside spherical surface 44 integrally built with multiple of reflective cells 47, each cell with plurality of cube corner reflective elements.

Reflective cells 47 having the inside surface integrally positioned about 20 to 30 degrees with respect to the planar base surface 45. Each reflective cell also forms an angle with respect to adjacent cell, said angle to have a value of about 5 to 30 degrees.

Each cell 47 directly on the vertex of wedge shaped top surfaces of hollow cavity walls 42*b*, thereby forming an air gap directly beneath the cube corner reflective elements within each cell. Cap portion 46 can be made of impact resistant and transparent polymeric material. Such polymeric materials are available either as a recycled or virgin polymer. When color reflectors are desired, a transparent pigment will be added to the polymer.

Marker 50*a* is another preferred embodiment of a non-reflective marker based on the present invention. Marker 50*a* can be made from recycled or virgin plastics such as ABS, Polypropylene, engineered plastic or any suitable high strength polymer. Engineered plastic is commonly referred to as thermosetting or thermoplastic polymers with various proportions of fiber reinforcement and/or inert materials added. Several compositions of this type of polymers are available and readily marketed, either as a recycled or virgin polymer. Marker 50*a* having one-piece body 40*a* with sealed spherical top surface 41*a*, said body 40*a* including multiple hollow cavities 45*b*, each with an open end at a recessed part 45*c* of planar base surface 45*a*. Each hollow cavity 45*b* ends approximately 0.10-inch bellow the outside spherical surface 41*a*. A planar cap portion 52 can be welded to the recessed part 45*c* of the planar base surface 45*a* where the open ends of hollow cavities 45*b* are located. These types of reflective or non-reflective markers can effectively be used to replace the highly brittle ceramic markers, because it can retain surface brightness due to having minimum contact with tire surfaces, maximum base adhesive wetting parameter and lower production cost and shorter production cycle due to the multiple hollow cavities within the marker's body. Markers 50 and 50*b* can be coated with abrasion resistant vapor deposited diamond like film or silicon dioxide film for added surface enhancement and durability.

Another preferred embodiment is roadway marker 60, as illustrated in FIGS. 18 through 22. Marker 60 ideally suited for use as a multi colored or one color marker with two reflective sides. Marker 60 can be formed having two parts 61 connected with a tear able thin wedge 66*a*. The two parts welded or agglutinated at the backside 67.

Each part 61 integrally comprises a planar top surface 66, a sealed planar base surface 65 with textured grooves 65*a,* two multi angled sides 64, an inclined planar face 62 and backside 67 vertical with respect to planar base surface 65, said backside including hollow cavities 69.

The inclined planar face 62 includes a planar surface 62*a* and recessed portion 62*b*. Recessed portion 62*b* having the open ends of hollow cavities 68 and the wedge shaped top surfaces 63*a* of hollow cavity walls 63. A reflective plate 70 is either welded or agglutinated to the wedge shaped top surface 63*a*, thereby retaining cell like inside areas of the reflective plate with plurality of cube corner reflective elements tightly within an air gap inside each corresponding hollow cavity 68. Hollow cavities 68 are integrally formed having a centerline near perpendicular to planar face 62 and a depth that terminate about 0.05 to 0.10 inch above the planar base surface 65.

Hollow cavity walls 63 form an inward angle of about 2 to 5 degrees with respect to the centerline of each corresponding hollow cavity. Another of the hollow cavities 69, is open within the backside 67. Cavities 69 can be of any eject-able shape. Part 61 can be made of various recycled or virgin polymeric materials comparable to the material of reflective plate 70 with the desired color added. Reflective plate 70 can have either planar outside surfaces or slightly recessed cell like planar surfaces corresponding to the shapes of the opening of the hollow cavities 68.

The inside of reflective plate 70 is sonically welded to the wedge shaped top surface 63*a* of hollow cavity walls 63.

Hence, cell-like areas are formed on said inside surface of reflective plate 70, each cell can retain a plurality of the cube-corner reflective elements within a corresponding hollow cavity 68. FIG. 21 through FIG. 24 illustrates another preferred embodiment of the present invention.

Marker 80 which comprises a monolithically formed, one piece hollowed structural body 90 and two reflective plates 97 for attachment to said body 90 comprises: thus two reflective faces 91, two arcuate sides 95, textured and sealed base surface 98 with discontinuous grooves and a planar top surface 99. Said inclined reflective faces 91 each having a recessed planar portion 92 where the reflective plates 97 are welded, said recessed portions 92, each includes wedged shaped top surfaces 96 as an integral part of each load carrying partition walls 93.

Partition walls 93 define horizontally positioned, hollow cavities 94. Each hollow cavity 94 having a centerline parallel to the planar base surface 98.

Figure 23:
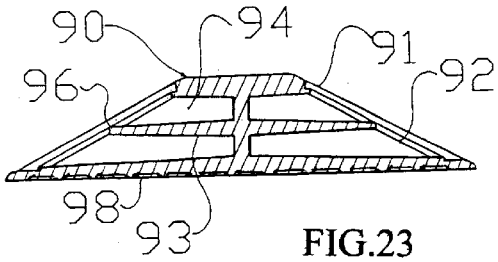
FIG. 23 is a cross sectional view taking along line 23—23 of marker body, as in FIG. 21.
Figure 23B:
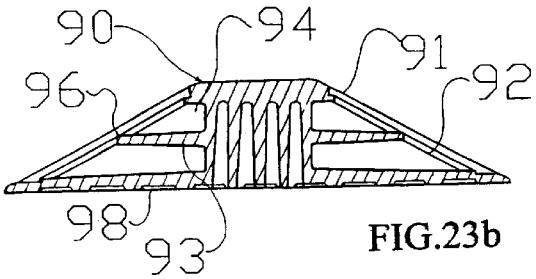
Figure 24:
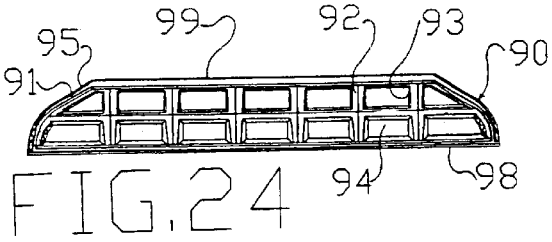
FIG. 24 is an elevation view of the one-piece reflective marker body, as in FIG. 21.
Figure 22:
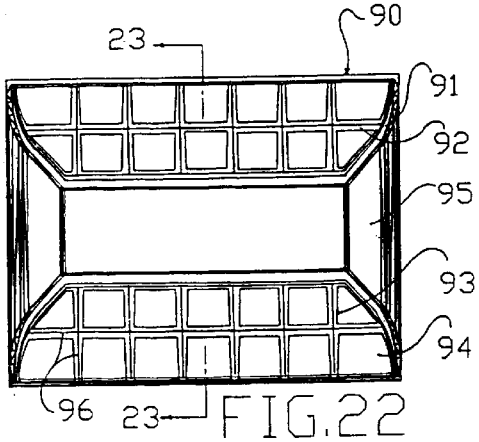
FIG. 22 is a plan view of reflective of the one-piece marker body, as in FIG. 21.
Figure 26:
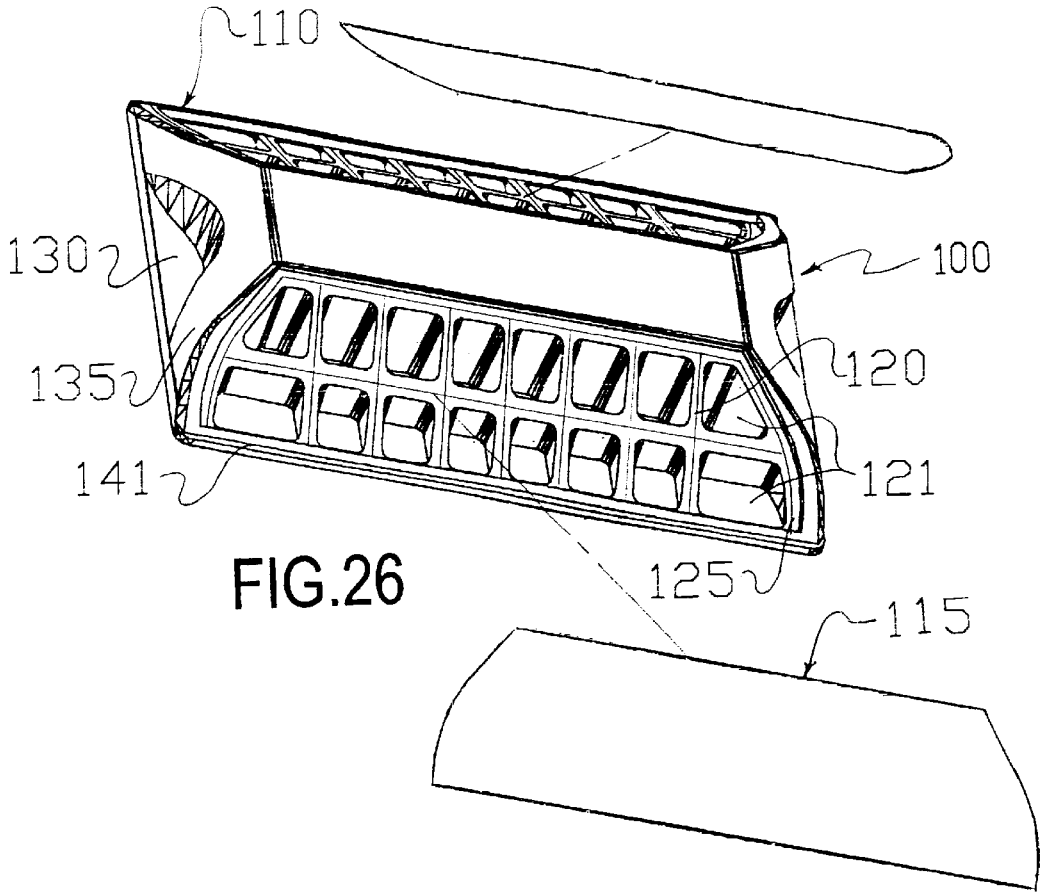
FIG. 26 is an isometric view of yet another embodiment of the marker body of this invention.
Figure 25:
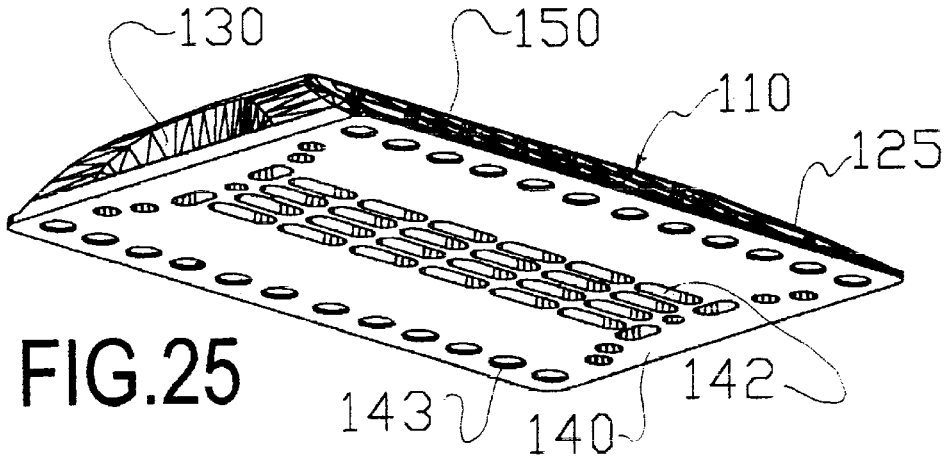
FIG. 25 is a lower isometric view of another marker structural body, as in FIG. 26.
Figure 28:
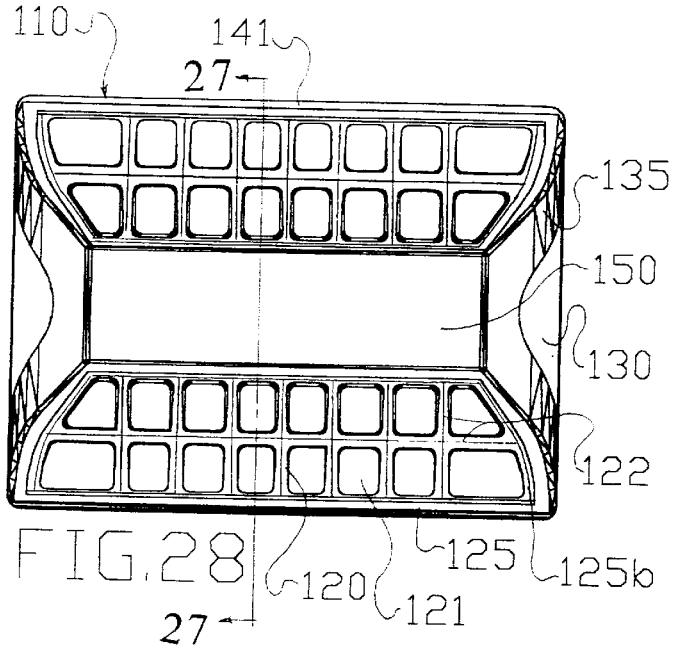
FIG. 28 is a plan view of the marker structural body, as in FIG. 26.
Figure 27:
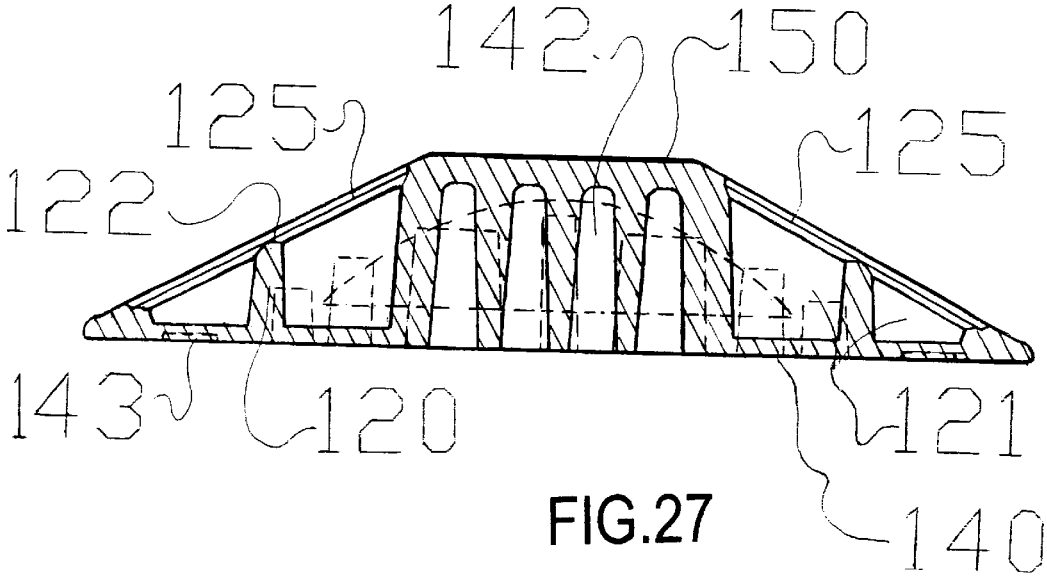
FIG. 27 is a cross sectional view of the marker body taking along line 27—27, as in FIG. 28.

The load carrying walls 93 have inwardly formed surfaces, starting at the open ends of the cavities 94 within the recessed portions 92. The intersections of each two inwardly formed surfaces can be filled so that a smooth ejection cycle can be achieved. The depth of each hollow cavity can be terminated anywhere about 0.05 to 0.50 inch from the mid point of said marker base depth. The reflective faces 91 each can have one row or two rows of hollow cavities. The discontinuous grooves within the planar base surface 98 can have various sizes, shapes and depths, said depth can be of about 0.03 to 0.50 inch. The cross section of two alternative bodies is shown in FIGS. 23 and 23*b*.

FIG. 25 through FIG. 28 illustrate yet another preferred embodiment of the present invention. Marker 100 also comprises of a monolithically formed one piece hollowed structural body 110 and two planar reflective plates 115 for attachment, said body 110 integrally having two inclined planar faces 125, two arcuate sides 135 each with recessed grip slot 130, a sealed, textured base surface 140 with small recesses 142 and 143 having variable depths of about 0.03 to 0.55 inches and planar top surface 150, said inclined planar faces 125 each having a recessed planar area 125*b* where the reflective plates 115 are welded. Each recessed area 125*b* includes wedge shaped top surfaces 122 monolithically formed as part of each end of load carrying partition walls 120. The partition walls 120 integrally intersect each other, thereby forming multiple, vertically positioned, hollow cavities 121, said partition walls 120 having surfaces that are inwardly inclined at an angle of about 2 to 5 degrees with respect to the centerline of each corresponding hollow cavity 121. Each hollow cavity 121 is having a centerline near vertical to the planar base surface 140.

Each load carrying partition wall 120 has inwardly formed surfaces, starting at the lower ends of its corresponding top wedge shaped portion 122 within the recessed area 125*b*.

The intersections of each two adjacent walls 120 can be rounded so that smooth ejection cycle can be achieved during the injection molding of the monolithically formed structural body 110. The depth of each hollow cavities 121 can be terminated about 0.05 to 0.15 inch above said outside planar base surface 140.

Each inclined planar face 125 can have one row or trows of hollow cavities. The recesses within the planar base surface 140 can have various sizes, shapes and depths, said depth can be of about 0.03 to 0.55 inches. The planar reflective plates 115 integrally having transparent planar outside surface and an inside surface with plurality of cube reflective elements, preferably the reflective elements are of the micro cube corner elements having heights of about 0.0045 to 0.0125 inches. Any commonly available cube corner element can also be used.

The outside planar surface of the reflective plates 115 can be further improved for scratch resistance by means of chemical vapor deposition of a hard carbon film. This carbon film can have abrasion resistance strength equal or greater than glass; thereby providing a much better mechanical adhesion to plate 115.

Various processes can be used as means for deposition of this carbonaceous, film on the outside planar surface of reflective plate 115. All theses processes utilize vacuum deposition chambers. One of the preferred means incorporate a hybrid process using radio frequency plasma enhanced chemical vapor deposition systems.

A second major group utilizes the means of incorporating plasma ion beam assisted by a precursor gas in a vacuum deposition chamber.

The amorphous carbon film can be deposited in a gradual means, starting with a layer having low hydrogen content, thereby tenaciously adhering to the outside surface of the reflective plate 115.

This first layer can be about 100 angstrom or thicker. Immediately thereafter, a harder carbon layer is deposited with slightly higher hydrogen content and having about 100 to 500 angstrom in thickness. Various means are available that provide adjustments to the pressures or the bias voltage applied during plasma CVD, thereby controlling hardness of these layers.

In some processes, a polymeric intermediate layer, such as siloxanes or silazanes, are deposited within the vacuum chamber between the substrate, the plate surface 115, and the hard carbon layer that is deposited using chemical vapor deposition methods. This polymeric prime coat may improve UV resistance, mechanical adhesion as well as improving the rate of deposition of the amorphous carbon film.

The present invention includes within its scope a method for making the monolithically formed reflective pavement marker or delineator, comprising the steps:

selecting the pavement marker shape, polymers to be used, types of cube corner reflective elements to be used, body shape, shape of reflective cells, used and the injection molding method to be utilized for said method of making, providing tooling means which allow the injection molding of said monolithically formed reflective pavement marker body, integrally including the hollow cavities and the sealed planar base surface in one step, said tooling can be made to mold said marker having one color or two colors, and the tooling means for molding of the reflective plates integrally with cube corner reflective elements, providing the means for coating the reflective plates with a carbonaceous film for abrasion resistance, utilizing plasma enhanced chemical vapor deposition processes or plasma ion beam assisted deposition processes, said abrasion resistance carbon coat can be preceded by an intermediately deposited polymeric layer of silaxones or other polymer, providing the partition and load carrying wall means with wedge shaped top surface which allow portion of the inside surface of the reflective plate to be agglutinated to said wedge shaped top surfaces of said wall means, thereby freely retaining multiple cube corner reflective elements within air gaps inside of each hallow cavity, providing the angular position for the centerlines of the hollow cavities to be about 90 to 100 degrees with respect to the planar base surface of said pavement marker body, to allow uninterrupted ejection cycle during said injection molding of said reflective pavement marker body.

It is understood that various changes or modifications can be made within the scope of the appended claims to the above-preferred method of forming one-piece reflective marker without departing from the scope and the spirit of the invention. The principle processes of this invention are not limited to the particular embodiments described herein. Various embodiments can employ the processes of this invention. This invention is not limited to the exact method illustrated and described; alternative methods can be used to form the intended monolithically formed reflective pavement marker body as well as the reflective plates of this invention.

Therefore, the invention can be practiced otherwise than as specifically described herein.

What is claimed is:

1. A method for making a retro-reflective pavement marker having a monolithically formed one-piece hollowed structural body and at least one reflective plate attachment, said hollowed structural body having two arcuate sides each with recessed grip slot, a planar top portion, a textured, sealed planar base surface with circular recesses or grooves of about 0.03 to 0.55 inches in depth and two inclined planar faces, each of said faces having a planar recessed portion, said monolithically formed hollowed body having plurality of partitioning and load carrying walls ending within said two inclined planar faces, said load carrying walls defining said hollow cavity air gaps within said monolithically formed body, said hollow cavity air gaps having open ends within said planar recessed portion of said inclined faces, said hollow cavity air gaps being formed either within one row or two rows, said hollow cavity air gaps each having a centerline forming an angle of about 90 to 100 degrees with respect to the outside of said planar base surface, said load carrying walls each integrally having a wedge shaped top surface protruding within said planar recessed portions of said inclined faces, said wedge shaped top surfaces being adopted to maximize the air gap areas at the open ends of said hollow cavity air gaps, said reflective plate having an inside surface with a plurality of cube corner reflective elements, said cube corner reflective elements each having a height of about 0.0045 to 0.045 inch and abrasion resistant coating means associated with reflective plates for coating the reflective plate, outside planar surface with scratch resistance;

said method for making a retro-reflective pavement marker comprising the steps:

a) selecting the pavement marker shape, type of polymers used, types of cube corner reflective elements to be incorporated, shape of hollow cavity air gaps used within said monolithically formed body and the injection molding method to be utilized for said method of making;

b) providing tooling means which allow the injection molding of said reflective pavement marker body, monolithically including the load carrying partition walls and the sealed, textured planar base surface in one step molding, said tooling means provide for molding transparent reflective plates integrally with plurality of cube corner reflective elements, said plates provided with tapered periphery edges;

c) providing the load carrying partition walls of said monolithically formed body with wedge shaped top surfaces within said recessed portion of the inclined faces, whereby allowing maximum numbers of cube corner reflective elements to be retained in cells within inside of said hollow cavities, d) providing the position of said hollow cavity air gaps each forming an angle of about 90 to 100 degrees with respect to the planar base surface, said hollow cavities allowing uninterrupted ejection cycle during said injection molding of said monolithically formed pavement marker body, e) welding the reflective plates to said recessed portions of the inclined faces of said monolithically formed one-piece pavement marker body, wherein said reflective pavement marker is formed, said reflective pavement marker can have one of the reflective plates replaced by an opaque plate to form a reflective marker with one reflective face, f) providing coating means for either coating entire outside surfaces of the said reflective pavement marker or the reflective plates with abrasion and scratch resistance hard carbon film, said coating means can utilize plasma enhanced chemical vapor deposition methods or plasma ion beam assisted deposition methods, said coating means shall be deposited inagradual process where the first of about 100 to 200 angstrom will contain the least amount of hydrogen for better adhesion, then immediately followed by a hard carbon coat of about 200 to 500 angstrom, with equal or greater abrasion resistance strength, Whereby said reflective pavement marker is formed from two elements welded together, said monolithically formed structural body and said one or two reflective plates.

* * * * *